US010450846B2

(12) United States Patent
Jabs et al.

(10) Patent No.: US 10,450,846 B2
(45) Date of Patent: Oct. 22, 2019

(54) HYBRID PUSH AND PULL METHOD AND SYSTEM FOR EXPANDING WELL TUBULARS

(71) Applicant: SHELL OIL COMPANY, Houston, TX (US)

(72) Inventors: Matthew Jay Jabs, Katy, TX (US); Antonius Leonardus Maria Wubben, Rijswijk (NL); Djurre Hans Zijsling, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 5 days.

(21) Appl. No.: 15/855,264

(22) Filed: Dec. 27, 2017

(65) Prior Publication Data

US 2018/0119527 A1 May 3, 2018

Related U.S. Application Data

(63) Continuation of application No. PCT/EP2016/064990, filed on Jun. 28, 2016.

(60) Provisional application No. 62/187,378, filed on Jul. 1, 2015.

(51) Int. Cl.
*E21B 33/12* (2006.01)
*E21B 43/10* (2006.01)

(52) U.S. Cl.
CPC ..... *E21B 43/105* (2013.01); *E21B 33/12* (2013.01); *E21B 43/103* (2013.01); *E21B 43/108* (2013.01)

(58) Field of Classification Search
CPC ..... E21B 33/12; E21B 43/103; E21B 43/105; E21B 43/108
See application file for complete search history.

(56) References Cited

U.S. PATENT DOCUMENTS

| | | | | |
|---|---|---|---|---|
| 3,162,245 | A * | 12/1964 | Fast | E21B 43/105 166/207 |
| 7,004,257 | B2 | 2/2006 | Simpson et al. | |
| 8,397,826 | B2 | 3/2013 | O'Connor et al. | |
| 9,422,794 | B2 * | 8/2016 | Di Crescenzo | E21B 43/103 |
| 2004/0173361 | A1 | 9/2004 | Lohbeck | |
| 2005/0161226 | A1 * | 7/2005 | Duggan | E21B 43/103 166/380 |

(Continued)

FOREIGN PATENT DOCUMENTS

WO 2012104257 A1 8/2012

OTHER PUBLICATIONS

International Search Report and Written Opinion for PCT Patent Application No. PCT/EP2016/064990, dated Oct. 25, 2016, 11 pages.

*Primary Examiner* — Daniel P Stephenson

(57) ABSTRACT

A hybrid push and pull method for expanding a tubular in a wellbore utilizes an expansion assembly with a sealed and another, optionally expandable, cone, wherein during at least part of the expansion process the sealed cone is moved up through the tubular by a combination of push and pull forces and the push force is generated by pumping fluid at an elevated pressure into a space between the bottom plug and the expansion assembly. This allows staged expansion of the tubular in a hard rock formation and/or of a tubular surrounded by a hardened cement lining and/or of a pair of partially overlapping nested tubular ends.

19 Claims, 3 Drawing Sheets

(56) References Cited

U.S. PATENT DOCUMENTS

| | | | | |
|---|---|---|---|---|
| 2006/0054330 | A1* | 3/2006 | Ring | E21B 43/105 166/380 |
| 2006/0266527 | A1* | 11/2006 | Brisco | E21B 21/10 166/380 |
| 2007/0034408 | A1 | 2/2007 | Benzie et al. | |
| 2007/0056743 | A1* | 3/2007 | Costa | E21B 43/103 166/380 |
| 2007/0221374 | A1 | 9/2007 | Filippov et al. | |
| 2008/0190616 | A1 | 8/2008 | Watson | |
| 2009/0014172 | A1* | 1/2009 | Costa | E21B 7/20 166/207 |
| 2009/0266560 | A1 | 10/2009 | Ring et al. | |
| 2011/0011578 | A1* | 1/2011 | Noel | B21D 39/20 166/216 |
| 2012/0085549 | A1* | 4/2012 | O'Connor | E21B 43/105 166/380 |
| 2013/0098634 | A1 | 4/2013 | O'Connor et al. | |
| 2013/0140022 | A1* | 6/2013 | Leighton | E21B 29/10 166/277 |
| 2013/0319692 | A1* | 12/2013 | Abedrabbo | E21B 43/10 166/384 |
| 2015/0292305 | A1* | 10/2015 | Galloway | E21B 43/105 166/380 |
| 2018/0119527 | A1* | 5/2018 | Jabs | E21B 43/103 |
| 2018/0187525 | A1* | 7/2018 | Zijsling | E21B 43/103 |

* cited by examiner

HYBRID PUSH AND PULL METHOD AND SYSTEM FOR EXPANDING WELL TUBULARS

CROSS REFERENCE TO RELATED APPLICATIONS

This is a Continuation application of International Application No. PCT/EP2016/064990, filed 28 Jun. 2016, which claims priority benefit of US Provisional Application No. 62/187,378, filed 1 Jul. 2015.

FIELD OF THE INVENTION

The present invention relates to methods and systems for expanding a tubular in a wellbore.

BACKGROUND OF THE INVENTION

A known well tubular expansion system and method are disclosed in U.S. Pat. No. 9,422,794. In this known method a well tubular is expanded by pulling an expansion cone therethrough.

A disadvantage of the known method is that cement set in the annulus surrounding the expanded well tubular and/or a surrounding hard rock formation and/or another surrounding previously installed host casing may inhibit the expansion process so that the cone may be stuck within the partially expanded well tubular and needs to be drilled out.

There is a need for an improved expansion method and system wherein the risk of stalling of the expansion assembly is inhibited.

SUMMARY OF THE INVENTION

In accordance with the invention there is provided a method for expanding a tubular in a wellbore, the method comprising:

- providing an expansion assembly comprising an upper cone and a lower cone that are suspended from a drill string assembly;
- configuring the lower cone such that it can be expanded to a larger outer width than the upper cone and can be collapsed to a smaller outer width than the upper cone;
- configuring at least one of the cones as a sealed cone such that its outer surface engages the tubular expanded thereby in a sealing arrangement so that fluid transfer across the cone is inhibited during the expansion process;
- providing the tubular with a bottom plug that is arranged or pulled into the lower end of the tubular;
- providing the drill string and expansion assembly with a central passageway and fluid discharge opening through which fluid can be pumped into a space between the bottom plug and expansion assembly;
- inserting the expansion assembly, tubular and bottom plug into the wellbore;
- inducing the upper cone to expand at least a substantial part of the tubular;
- inducing the lower cone to expand a lower part of the tubular to a larger width than that of the parts of the tubular expanded by the upper cone; and
- wherein during at least part of the expansion process at least the sealed cone is moved up through the tubular by a combination of push and pull forces and the push force is applied by pumping fluid at an elevated pressure through the central passageway and fluid discharge opening into the space between the bottom plug and expansion assembly The upper cone may be configured as the sealed cone and comprise a substantially conical solid body which is traversed by the central passageway and has a frusto-conical outer surface, which is during the expansion process in sealing engagement with the tubular expanded thereby.

Alternatively the upper cone is a segmented collapsible and expandable cone of which the cone segments are mounted on a frusto-conical carrier body which is traversed by the central passageway and the segments are during the expansion process in an expanded position and in a sealing arrangement with each other and with the carrier body and the tubular expanded thereby.

The lower bell cone may be a segmented expandable cone of which the segments are expanded during the expansion process in a mutually spaced configuration such that gaps are present between adjacent pairs of segments.

In accordance with the invention there is furthermore provided a system for expanding a tubular in a wellbore comprising:

- an expansion assembly comprising an upper cone and a lower cone that are suspended from a drill string assembly;
- the lower cone being configured such that it can be expanded to a larger outer width than the upper cone and can be collapsed to a smaller outer width than the upper cone;
- at least one of the cones being configured as a sealed cone such that its outer surface engages the tubular expanded thereby in a sealing arrangement so that fluid transfer across the cone is inhibited during the expansion process;
- a bottom plug that is arranged or pulled into the lower end of the tubular;
- a central passageway and fluid discharge opening in the drill string and expansion assembly through which fluid can be pumped into a space between the bottom plug and expansion assembly;
- means for inserting the expansion assembly, tubular and bottom plug into the wellbore;
- means for inducing the upper cone to expand at least a substantial part of the tubular;
- means for inducing the lower cone to expand a lower part of the tubular to a larger width than that of the parts of the tubular expanded by the upper cone; and
- means for moving at least the sealed cone up through the tubular during at least part of the expansion process by a combination of push and pull forces and the push force can be generated by pumping fluid at an elevated pressure through the central passageway and fluid discharge opening into the space between the bottom plug and expansion assembly.

These and other features, embodiments and advantages of the expansion method and system according to the invention are described in the accompanying claims, abstract and the following detailed description of non-limiting embodiments depicted in the accompanying drawings, in which description reference numerals are used which refer to corresponding reference numerals that are depicted in the drawings.

Similar reference numerals in different figures denote the same or similar objects. Objects and other features depicted in the figures and/or described in this specification, abstract and/or claims may be combined in different ways by a person skilled in the art.

BRIEF DESCRIPTION OF THE DRAWINGS

FIG. 3*a* shows the expansion assembly, FIG. 3*b* shows expansing of the cones, and FIG. 3*c* shows completion of a bell section.

DETAILED DESCRIPTION OF THE DEPICTED EMBODIMENTS

Described herein are a hybrid push and pull method and system for expanding well tubulars in an underground wellbore. The hybrid push and pull method and system provide a semi or full MOnoDiameter (MOD) multiple liner deployment system and method of installation of which the expansion forces are large enough to overcome resistance by surrounding formation and cured cement properties.

Thereto it is desirable that the system has at least one of the following capabilities:

- Reaming-in capability including hydraulics.
- Suitable for high over-pull capacity rigs (floater) in combination with a Top Anchor and Pull (TAaP) tubular expansion system.
- Suitable for low over-pull capacity rigs (TLP-rigs) in combination with the Jack And Pull (JAP) system.
- After the bottom plug has been set in the liner the expansion can be completed using hydraulically assisted expansion.
- Open Hole Anchors can be used as a contingency option for the installation process.

Figure 1:
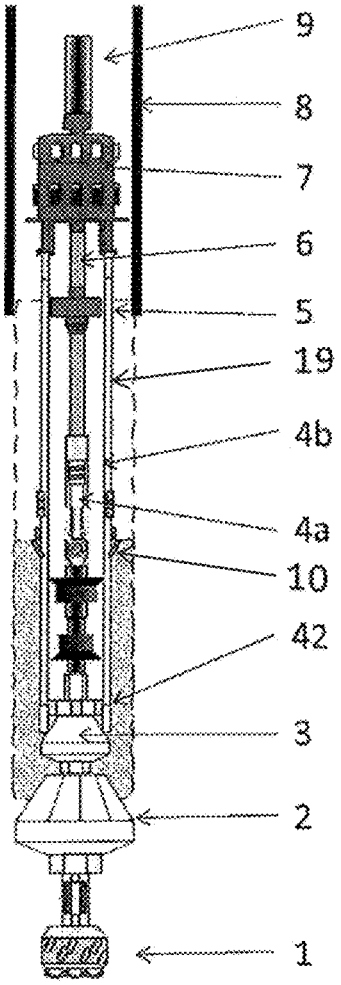
FIG. 1 shows a Top Anchor and Pull (TAaP) assembly.
Figure 2:
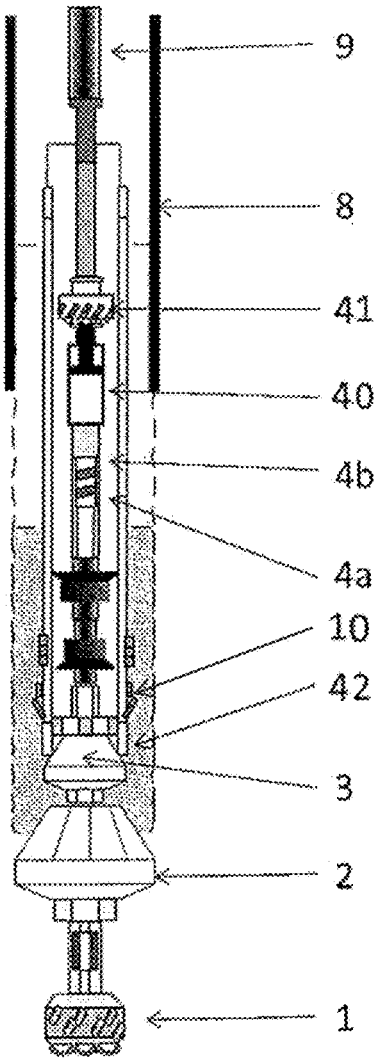
FIG. 2 shows a Jack And Pull (JAP) assembly.

FIGS. 1 and 2 show schematics of expansion assemblies. The expansion systems shown in FIGS. 1 and 2 thereto comprise an expansion tool string which contains from bottom to top:

- A reaming/jetting head with an integrated bottom plug 1, which can be set in the expanded liner.
- An expandable cone 2 designed to expand the liner from the nominal expanded inner diameter to an inner diameter for the bell which is typically equal to the main section Internal Diameter (ID) plus two times a wall thickness of the expandable liner.
- A solid main cone 3 to expand the upper part of the liner including the overlap section with the previously expanded liner.
- An on-off sub 4*a* suitable to connect the upper part of the expansion tool string to the lower part of the expansion tool string.
- An upper part of the expansion assembly, which for the TAaP system shown in FIG. 1 comprises: the counter part 4*b* of the on-off sub 4*a*, an interceptor sub 5, a section of drill pipe 6, and a Top Anchor or SETA tool 7. The Top Anchor or SETA tool 7 can be anchored in the host casing 8 to enable initiation of the expansion process by rig over-pull and drill pipe 9 to the rig and which can be released by the interceptor sub 5.

For the JAP system shown in FIG. 2, the upper part of the expansion assembly comprises: the counter part 4*b* of the on-off sub 4*a*, a hydraulic jack 40, and a cyclic gripper 41. The cyclic gripper 41 anchors the expansion tool string against the expandable liner 19 to prevent upward movement of the liner while the jack is stroking-in and drill pipe 9 to the rig.

The expandable liner 19 is supported by the expansion tool string via a starter joint 42 at the bottom of the liner 19, which locks the liner in axial and rotational direction w.r.t. the tool string and which can be released from the expansion tool string by application of excess force to the expansion cone.

Figure 4:
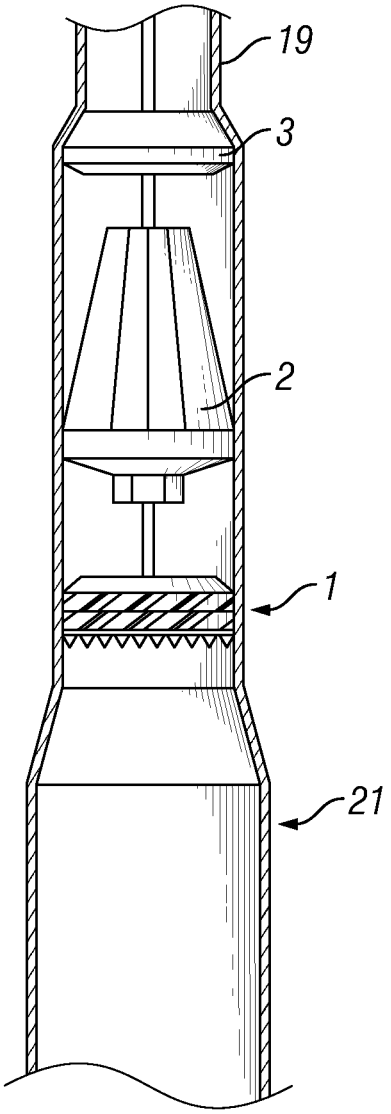
FIG. 4 schematically shows further pulling up the upper cone until the bottom plug is in the section above the bell section, which has been expanded by the upper cone only.

The installation of an expandable liner using the TAaP system shown in FIG. 1 may be conducted by the following steps:

a) While the expansion assembly is run into the hole it can be rotated and drilling fluid can be circulated to wash/ream the assembly to the bottom of the open hole.

b) A dart is pumped down which seats in a dart catcher which may be located in the bottom plug 1.

c) Pressure is applied to activate the SETA tool and the expandable cone; with increased pressure the dart is released to open the bore of the expansion tool string again.

d) Cement is pumped and the trailing cement plug seats in the bottom plug.

e) The cone is released from the starter joint by rig over pull while maintaining pressure in the bore of the expansion tool string to expand the bell section.

f) When the bell section is completed the expandable bell cone is collapsed. This may be accomplished mechanically by application of a set-down weight or hydraulically by cycling the pressure in the bore of the tool string.

g) The main cone is pulled up until the bottom plug is in the section expanded by the main cone above the bell section 21. This is schematically shown in FIG. 4.

h) Pressure is applied in the bore of the tool string to hydraulically clad the bottom plug against the expanded liner. Once the bottom plug is set the bore of the tool string is connected to the area between the cone and the bottom plug.

i) The upper section of the liner is expanded by applying hydraulic pressure below the cone until the cone has progressed to the bottom of the host casing.

j) In case the maximum allowable hydraulic pressure in the expanded liner is not sufficient to clad the liner against the bell of the host liner rig over pull may be applied to complete the expansion of the overlap by mechanically assisted hydraulic expansion.

k) Upon completion of the cladding the expansion tool string pulled out of the hole.

l) The bottom plug has to be drilled out with a pilot bit & under-reamer assembly to ensure removal of cement from the inner diameter of the bell.

The installation of an expandable liner using the JAP system shown in FIG. 2 may be conducted in the following steps:

a) While the expansion assembly is run into the hole it can be rotated and drilling fluid can be circulated to wash/ream the assembly to the bottom of the open hole.

b) Cement is pumped with a two stage trailing dart. The dart seats in the bottom plug 1.

c) Pressure is applied to activate the cyclic gripper 41 and the jack 40 and the bell cone. Upon increasing the pressure the main cone is released from the starter joint.

d) The bell section is expanded by cycling the jack and applying an over pull for resetting of the jack.

e) When the bell section is completed the bell cone is collapsed. This may be accomplished by applying a set-down weight.

f) The main cone is jacked up until the bottom plug is in the section expanded by the main cone.

g) Upon increasing the pressure at the end of a stroke of the jack, the second stage of the dart is released which opens a port to enable the bottom plug to be hydraulically clad against the expanded liner. Once the bottom plug is set the bore of the tool string is connected to the area between the cone and the bottom plug.

h) The upper section of the liner is expanded by applying hydraulic pressure below the cone until the cone has progressed to the bottom of the host casing.

i) In case the maximum allowable hydraulic pressure in the expanded liner is not sufficient to clad the liner against the bell of the host liner rig over pull may be applied to complete the expansion of the overlap by mechanically assisted hydraulic expansion.

j) Upon completion of the cladding the expansion tool string is pulled out of the hole.

k) The bottom plug has to be drilled out with a pilot bit & under-reamer assembly to ensure removal of cement from the inner diameter of the bell.

Once the bottom plug has been set and pressure is applied through the drill string, the first part of the expansion is provided by a combination of jacking force and pressure below the cone. Once the jack is fully stroked-in the hydraulic pressure in the tool string is increased to a level which is sufficient to progress the cone further until a stand of drill pipe has to be removed from the drill pipe section.

This offers an option to apply a high expansion force to the cone by making use of the combined force generated by the jack and the pressure below the cone up to the burst pressure of the expanded liner. This option may be used in case the cone encounters obstructions around the liner e.g. formation cavings in the open hole.

It is observed that after expansion of a first liner it has a fixed bell length. The installation of a second expandable liner in the bell of the first expandable liner may result in the upper part of the bell section not covered by the second expanded liner because the shortening of the second liner during expansion depends of a multitude of factors which cannot be predicted accurately.

Consequently the collapse rating of the MOD system is governed by the collapse pressure of the bell section which is lower than that of the liner section expanded with the main cone. (The collapse strength of an expanded pipe reduces with increasing expansion ratio).

To eliminate this, the installation process may be modified as follows:

- The length of the second liner is designed such that in case of maximum shortening during expansion the top of the liner will be higher than the top of the bell section of the host liner.
- The expansion of the second liner is performed until the main cone gets stuck at the top of the bell section of the host liner.
- Then the cone is pushed down and the upper part of the expansion assembly is disconnected from the lower part by unscrewing the on-off sub and pulled out of the hole.
- An assembly is made up and run in the hole which comprises from bottom to top:
- The upper part 4*b* of the on-off sub 4*a*
- A pipe cutter which is known from US patent application No. 2008/0190616 and U.S. Pat. No. 7,004,257 and commercially available with a diameter equal to that of the cone when the arms are opened.
- Drill pipe to the rig.
- The pipe cutter is run to a depth where the cutter arms will open in the expanded liner.
- A dart is pumped to open the cutter arms
- Cutting the excess unexpanded liner with the cutter tool at the expansion face; after completion the assembly is lowered into the expanded liner while the cutter arms carry the excess liner and the on-off-sub (4*a*,4*b*) is made-up with right-hand rotation.
- High flow rate & pressure may be applied to close a port to the nozzles of the pipe cutter such that a combination of rig over-pull and pressure below the cone may be used to pull the cone out of the overlap and pull the assembly out of the wells.
- As an option the cutter arms may be collapsed after the on-off sub has been made up such that the unexpanded liner is carried out of the well by the cone face.

Advantages of the combined push and pull tubular expansion method and system according to the invention shown in FIGS. 1 and 2 may include one or more of:

- Expansion force required are no longer dependent on the properties of the cement and formation surrounding the host liner
- Expansion forces are limited to the level required for expansion of a single liner
- The bell section is expanded in compression. In this expansion mode the maximum forming limit of the expandable liner is achieved. I.e.: in this mode the risk of fracturing of the liner in minimal.
- A second round trip can be added to the installation process to enable the bell of the host liner to be fully cladded with the second liner. This way the collapse rating of the MOD system is determined by the collapse of a single expanded liner rather than that of the bell section.
- Drilling out of the shoe of the liner does not require liner material to be drilled; this can be accomplished with a pilot bit.
- The clean-out of the cement in the bell section should be conducted with an under-reamer.
- For the TAaP system shown in FIG. 1:
- Liner can be scoped down after the bottom plug has been set.
- For the JAP system shown in FIG. 2:
- It is relatively simple
- Liner can be set at bottom of the well from the start scoping down is not need to get maximum liner shoe depth
- Offers option to generate very high force on the cone by combination of the jacking force and pressure below the cone.
- It is observed that:
- The systems critically depend on leak-tightness of the expandable connections in the liner section expanded with the main cone and the anchoring and leak-tightness of the bottom plug.
- The bell section of the liner will be filled with cement.
- The bottom plug and the cement in the bell have to be drilled-out; the latter requires an under-reaming device to ensure that all cement is removed from the bell ID surface.

FIG. 3 (parts a to c) show an alternative embodiment of the hybrid push and pull method and system according to the invention which:

- Has reaming-in capability including hydraulics.
- Makes use of two expandable cones for the upper part of the liner and for the lower bell section of the liner.
- Provides real MOD capability with identical internal post-expansion diameter for consecutive liners.
- Is suitable for high over-pull capacity rigs (floater) in combination with the TAaP system Is suitable for low over-pull capacity rigs (TLP-rigs) in combination with the JAP system After the bottom plug has been set in the liner the expansion can be completed using hydraulically assisted expansion.

Permits use of Open Hole Anchors 10 as a contingency option for the installation process.

Figure 3A:
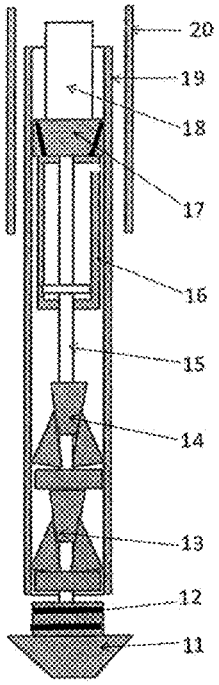
FIGS. 3*a*-3*c* show a tubular expansion assembly with two expandable cones
Figure 3B:
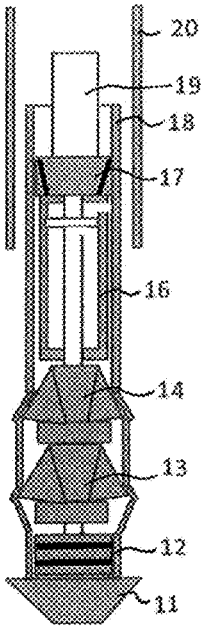
Figure 3C:
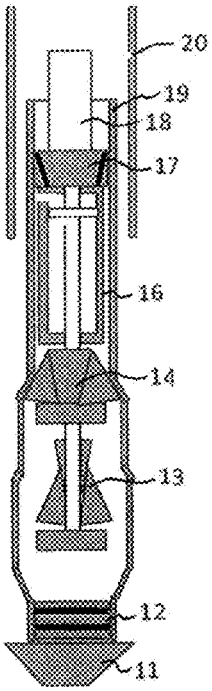

The expansion assembly shown in FIGS. 3*a-c* comprises the following components from bottom to top:

A reaming/jetting head 11.

A bottom plug 12, can be set in the bottom of the unexpanded liner, wherein the reaming/jetting head 11 is connected to the bottom plug 12.

An expandable cone 13 expands the liner to the inner diameter of the bell.

An expandable cone 14 expands the liner to its nominal diameter. The expandable cone 14 is provided with an integrated seal or a seal below the expansion face of the cone. The expanded diameter of the bell cone is equal to the expanded diameter of the upper cone plus two times the wall thickness of the expanded liner.

A tool string 15 which contains the components 12, 13 and 14 and which is connected to the piston rod of a hydraulic jack 16.

An anchor 17 which does not allow upward movement of the liner relative to the tool string.

Drill pipe 18 to the rig.

The expandable expansion cone assembly shown in FIGS. 3*a-c* may be used to install and expand an expandable liner 19 in an open hole to expand an overlap with a bell section of an already installed liner 20 by the following steps:

a) While the expansion assembly is run into the hole it can be rotated and drilling fluid can be circulated to wash/ream the assembly to the bottom of the open hole.

b) Cement is pumped with a trailing dart which seats in the bottom plug 12. This closes the tool string at the bottom.

c) Upon application of pressure in the bore of the tool string the jack is activated and strokes-in. During stroking-in both cones are expanded and the bottom plug is pulled into the unexpanded liner (FIG. 3*b*). At the end of the stroke the anchor may be unlocked to activate the cyclic gripper functionality.

d) After re-setting of the jack the bottom plug is pulled against the bottom of the unexpanded part of the liner and mechanically set. Upon application of an increased pressure the bottom plug is sheared off from the tool string 15. This connects the bore of the tool string to the area below the expandable cones.

e) The bell section may be expanded by cycling the jack with pressure below the cone to assist to expand the bell section in compression. Alternatively the pressure in the bore of the tool string may be increased after the jack has stroked-in to provide sufficient pressure below the cones to expand the bell section hydraulically. This results in the bell being expanded in tension which is more demanding for the forming limit of the liner material.

f) When the bell section is completed the bell cone is collapsed as illustrated in FIG. 3*c*. This may be accomplished by applying a set-down weight.

g) The upper part of the liner is expanded hydraulically. In case the maximum allowable pressure in the expanded liner is not sufficient to clad the liner into the bell of the host liner, then rig over-pull can be added to complete the cladding of the liner through mechanically assisted hydraulic expansion h) Upon completion of the cladding the cone may be collapsed and the expansion tool string pulled out of the hole.

i) The bottom plug has to be drilled out with a pilot bit & under-reamer assembly to ensure removal of cement from the inner diameter of the bell.

Once the bottom plug has been set and pressure is applied through the drill string, the first part of the expansion is provided by a combination of jacking force and pressure below the cone. Once the jack is fully stroked-in the hydraulic pressure in the tool string is increased to a level which is sufficient to progress the cone further until a stand of drill pipe has to be removed from the drill pipe section.

This offers an option to apply a high expansion force to the cone by making use of the combined force generated by the jack and the pressure below the cone up to the burst pressure of the expanded liner. This option may be used in case the cone encounters obstructions around the liner such as formation cavities and rims surrounding the open hole.

After expansion of a first liner it has a fixed bell length. The installation of a second expandable liner in the bell of the first expandable liner will result in the upper part of the bell section not covered by the second expanded liner because the shortening of the second liner during expansion depends of a multitude of factors which cannot be predicted accurately.

Consequently the collapse rating of the MOD system is governed by the collapse pressure of the bell section which is lower than that of the liner section expanded with the main cone. (The collapse strength of an expanded pipe reduces with increasing expansion ratio).

To eliminate this, the installation process may be modified as follows:

The length of the second liner is designed such that in case of maximum shortening during expansion the top of the liner will be higher than the top of the bell section of the host liner.

The expansion of the second liner is performed until the main cone gets stuck at the top of the bell section of the host liner.

Then the cone is collapsed and the expansion assembly is pulled out of the well.

An assembly is made up and run in the hole which comprises a pipe cutter with a diameter equal to that of the cone when the arms are opened. Pipe cutters are known from prior art (e.g. US patent application No. US 2008/0190616; U.S. Pat. No. 7,004,257) and are commercially available.

The pipe cutter is run to a depth where the cutter arms will open in the expanded liner.

A dart is pumped to open the cutter arms

Cutting of the excess unexpanded liner with the cutter tool at the expansion face; after completion the excess liner is carried out of the well by the pipe cutter.

Advantages of the tubular expansion assembly shown in FIGS. 3*a-c* may include one or more of:

Cones are protected by the expandable liner while reaming-in the hole.

The procedure for cutting of excess liner from the overlap section is relatively simple.

Only a minor part of the liner is filled with cement during expansion.

Further features of the expansion assembly shown in FIGS. 3*a-c* are that:

It is a relatively complex, expensive system because of two expandable cones.

Drilling out of the bottom plug requires also a section of expandable liner to be drilled. This has to be accomplished with a pilot bit and under-reamer drilling assembly.

Therefore, the method, system and/or any products according to present invention are well adapted to attain the ends and advantages mentioned as well as those that are inherent therein.

The particular embodiments disclosed above are illustrative only, as the present invention may be modified, combined and/or practiced in different but equivalent manners apparent to those skilled in the art having the benefit of the teachings herein.

Furthermore, no limitations are intended to the details of construction or design herein shown, other than as described in the claims below.

It is therefore evident that the particular illustrative embodiments disclosed above may be altered, combined and/or modified and all such variations are considered within the scope of the present invention as defined in the accompanying claims.

While any methods, systems and/or products embodying the invention are described in terms of "comprising," "containing," or "including" various described features and/or steps, they can also "consist essentially of" or "consist of" the various described features and steps.

All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values.

Also, the terms in the claims have their plain, ordinary meaning unless otherwise explicitly and clearly defined by the patentee.

Moreover, the indefinite articles "a" or "an", as used in the claims, are defined herein to mean one or more than one of the element that it introduces.

If there is any conflict in the usages of a word or term in this specification and one or more patent or other documents that may be cited herein by reference, the definitions that are consistent with this specification should be adopted.

What is claimed is:

1. A method for expanding a tubular in a wellbore, the method comprising:

providing an expansion assembly comprising an upper cone and a lower cone that are suspended from a drill string assembly, whereby said drill string and expansion assembly are provided with a central passageway and fluid discharge opening through which fluid can be pumped from the drill string into a space below the expansion assembly;

providing a bottom plug suspended below the lower cone;

configuring the lower cone such that it can be expanded to a larger outer width than the upper cone and can be collapsed to a smaller outer width than the upper cone;

configuring at least the upper cone as a sealed cone such that its outer surface engages the tubular expanded thereby in a sealing arrangement so that fluid transfer across the cone is inhibited during the expansion process;

inserting the expansion assembly, tubular and bottom plug into the wellbore;

inducing the upper cone to expand at least a substantial part of the tubular;

inducing the lower cone to expand a lower part of the tubular to a larger width than that of the parts of the tubular expanded by the upper cone, while pulling the bottom plug into the lower part of the tubular;

when a bell section is completed, collapsing the lower cone;

further pulling up the upper cone until the bottom plug is in the section above the bell section, which has been expanded by the upper cone only;

setting the bottom plug against the expanded tubular; and expanding an upper section of the tubular, wherein during at least part of the expansion process the upper cone is moved up through the tubular by a combination of push and pull forces whereby the push force is applied by pumping fluid at an elevated pressure through the central passageway and fluid discharge opening into the space below the expansion assembly between the bottom plug and expansion assembly.

2. The method of claim 1, wherein the upper cone comprises a substantially conical solid body which is traversed by the central passageway and has a frusto-conical outer surface, which is during the expansion process in sealing engagement with the tubular expanded thereby.

3. The method of claim 1, wherein the upper cone is a segmented collapsible and expandable cone of which the cone segments are mounted on a frusto-conical carrier body which is traversed by the central passageway, and the segments are during the expansion process in an expanded position and in a sealing arrangement with each other and with the carrier body and the tubular expanded thereby.

4. The method of claim 1, wherein the lower cone is a segmented expandable cone of which the segments are expanded during the expansion process in a mutually spaced configuration such that gaps are present between adjacent pairs of segments.

5. The method of claim 1, wherein setting the bottom plug comprises hydraulically cladding the bottom plug against the expanded tubular.

6. The method of claim 1, wherein the bottom plug is integrated into a reaming/jetting head.

7. The method of claim 1, wherein the expanding of said lower part of the tubular to said larger width than that of the parts of the tubular expanded by the upper cone comprises expanding from an inner diameter of the tubular as expanded by the upper cone to an inner diameter equal to the an inner diameter of the tubular as expanded by the upper cone plus two times a wall thickness of the tubular.

8. A system for expanding a tubular in a wellbore, comprising:

an expansion assembly comprising an upper cone and a lower cone that are suspended from a drill string assembly, whereby said drill string and expansion assembly are provided with a central passageway and fluid discharge opening through which fluid can be pumped from the drill string into a space below the expansion assembly;

a bottom plug suspended below the lower cone, wherein the bottom plug is integrated into a reaming/jetting head;

the lower cone being configured such that it can be expanded to a larger outer width than the upper cone and can be collapsed to a smaller outer width than the upper cone;

at least the upper cone being configured as a sealed cone such that its outer surface engages the tubular expanded thereby in a sealing arrangement so that fluid transfer across the cone is inhibited during the expansion process;

the upper cone operable to expand at least a substantial part of the tubular to a nominal expanded inner diameter;

the lower cone operable to expand a lower part of the tubular to a larger width than the nominal expanded inner diameter of the parts of the tubular expanded by the upper cone, while pulling the bottom plug into the lower part of the tubular;

the bottom plug being settable in the nominal expanded inner diameter of expanded tubular; and the upper cone movable up through the tubular during at least part of the expansion process by a combination of push and pull forces and the push force can be generated by pumping fluid at an elevated pressure through the central passageway and fluid discharge opening into the space below the expansion assembly between the bottom plug and expansion assembly.

9. The system of claim 8, wherein the upper cone comprises a substantially conical solid body which is traversed by the central passageway and has a frusto-conical outer surface, which is during the expansion process in sealing engagement with the tubular expanded thereby.

10. The system of claim 8, wherein the upper cone is a segmented collapsible and expandable cone of which the cone segments are mounted on a frusto-conical carrier body which is traversed by the central passageway and the segments are during the expansion process in an expanded position and in a sealing arrangement with each other and with the carrier body and the tubular expanded thereby.

11. The system of claim 8, wherein the lower cone is a segmented expandable cone of which the segments are expanded during the expansion process in a mutually spaced configuration such that gaps are present between adjacent pairs of segments.

12. The system of claim 8, wherein the bottom plug is settable by hydraulically cladding the bottom plug against the expanded tubular.

13. The system of claim 8, wherein the lower part of the tubular after expansion has a larger width than the nominal expanded inner diameter of the parts of the tubular expanded by the upper cone of two times a wall thickness of the tubular.

14. A method for expanding a tubular in a wellbore, the method comprising:

providing an expansion assembly comprising an upper cone and a lower cone that are suspended from a drill string assembly;

configuring the lower cone such that it can be expanded to a larger outer width than the upper cone and can be collapsed to a smaller outer width than the upper cone;

configuring at least one of the cones as a sealed cone such that its outer surface engages the tubular expanded thereby in a sealing arrangement so that fluid transfer across the cone is inhibited during the expansion process;

providing the tubular with a bottom plug that is arranged or pulled into the lower end of the tubular;

providing the drill string and expansion assembly with a central passageway and fluid discharge opening through which fluid can be pumped into a space between the bottom plug and expansion assembly;

inserting the expansion assembly, tubular and bottom plug into the wellbore;

inducing the upper cone to expand at least a substantial part of the tubular;

forming a bell section in a lower part of the tubular that has been expanded by the upper cone, by inducing the lower cone to expand the lower part of the tubular to a larger width than that of the parts of the tubular expanded by the upper cone; and when the bell section is completed, collapsing the lower cone;

further pulling up the upper cone until the lower cone and the bottom plug are in a section of the tubular that has been expanded by the upper cone only and above the bell section of the tubular;

setting the bottom plug against the expanded tubular in the section of the tubular above the bell section;

expanding an upper section of the tubular, wherein during at least part of the expansion process at least the sealed cone is moved up through the tubular by a combination of push and pull forces and the push force is applied by pumping fluid at an elevated pressure through the central passageway and fluid discharge opening into the space between the bottom plug and expansion assembly.

15. The method of claim 14, wherein the upper cone is configured as the sealed cone.

16. The method of claim 15, wherein the upper cone comprises a substantially conical solid body which is traversed by the central passageway and has a frusto-conical outer surface, which is during the expansion process in sealing engagement with the tubular expanded thereby.

17. The method of claim 15, wherein the upper cone is a segmented collapsible and expandable cone of which the cone segments are mounted on a frusto-conical carrier body which is traversed by the central passageway and the segments are during the expansion process in an expanded position and in a sealing arrangement with each other and with the carrier body and the tubular expanded thereby.

18. The method of claim 15, wherein the lower cone is a segmented expandable cone of which the segments are expanded during the expansion process in a mutually spaced configuration such that gaps are present between adjacent pairs of segments.

19. A method for expanding a tubular in a wellbore, the method comprising:

providing an expansion assembly comprising an upper cone and a lower cone that are suspended from a drill string assembly;

configuring the lower cone such that it can be expanded to a larger outer width than the upper cone and can be collapsed to a smaller outer width than the upper cone;

configuring at least one of the cones as a sealed cone such that its outer surface engages the tubular expanded thereby in a sealing arrangement so that fluid transfer across the cone is inhibited during the expansion process;

providing the tubular with a bottom plug that is arranged or pulled into the lower end of the tubular wherein the bottom plug is integrated into a reaming/jetting head;

providing the drill string and expansion assembly with a central passageway and fluid discharge opening through which fluid can be pumped into a space between the bottom plug and expansion assembly;

inserting the expansion assembly, tubular and bottom plug into the wellbore;

inducing the upper cone to expand at least a substantial part of the tubular;

inducing the lower cone to expand a lower part of the tubular to a larger width than that of the parts of the tubular expanded by the upper cone; and wherein during at least part of the expansion process at least the sealed cone is moved up through the tubular by a combination of push and pull forces and the push force is applied by pumping fluid at an elevated pressure through the central passageway and fluid discharge opening into the space between the bottom plug and expansion assembly.

* * * * *